US007456809B2

(12) United States Patent
Lim et al.

(10) Patent No.: US 7,456,809 B2
(45) Date of Patent: Nov. 25, 2008

(54) APPARATUS AND METHOD OF DRIVING A PLASMA DISPLAY PANEL

(75) Inventors: Geun Soo Lim, Seongnam-si (KR); Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 586 days.

(21) Appl. No.: 10/974,025

(22) Filed: Oct. 27, 2004

(65) Prior Publication Data

US 2005/0093469 A1 May 5, 2005

(30) Foreign Application Priority Data

Nov. 5, 2003 (KR) ..... 10-2003-0077937

(51) Int. Cl.
*G09G 3/28* (2006.01)

(52) U.S. Cl. ..... 345/68; 345/60

(58) Field of Classification Search ..... 345/60–69, 345/207; 313/582, 584, 586, 574, 633, 585, 313/587; 315/169.1, 169.4, 169.3
See application file for complete search history.

(56) References Cited

U.S. PATENT DOCUMENTS 7,109,980 B2 * 9/2006 Shigeta et al. ..... 345/204
2003/0214244 A1 * 11/2003 Onozawa et al. ..... 315/169.3
2004/0104869 A1 * 6/2004 Jeong ..... 345/60

FOREIGN PATENT DOCUMENTS

EP 1 065 650 A2 1/2001
JP 08-320667 12/1996

* cited by examiner

*Primary Examiner*—Nitin Patel
(74) *Attorney, Agent, or Firm*—Ked & Associates, LLP

(57) ABSTRACT

The present invention relates to a plasma display panel, and more particularly, to an apparatus and a method of driving a plasma display panel. According to an embodiment of the present invention, an apparatus of driving an AC surface discharge type plasma display panel, which includes X-, Y-, and Z-electrodes for discharge initiation and discharge sustain, includes a central arithmetic logical unit, a reset drive unit, a data drive unit, a scan drive unit, and a sustain drive unit and wherein the sustain drive unit includes a unified sustain drive unit. Accordingly, an apparatus for driving a plasma display panel and method thereof according to the present invention includes the unified sustain drive unit, thereby enabling to raise the drive efficiency, to simplify the circuit configuration, and to reduce the circuit volume.

22 Claims, 6 Drawing Sheets

APPARATUS AND METHOD OF DRIVING A PLASMA DISPLAY PANEL

This Nonprovisional application claims priority under 35 U.S.C. § 119(a) on Patent Application No. 10-2003-0077937 filed in Korea on Nov. 5, 2003, the entire contents of which are hereby incorporated by reference.

BACKGROUND OF THE INVENTION

1. Field of the Invention

The present invention relates to a plasma display panel, and more particularly, to an apparatus and a method of driving a plasma display panel.

2. Description of the Background Art

FIG. 1 is a perspective diagram of a general AC type surface discharge plasma display panel. Referring to FIG. 1, a general AC type surface discharge plasma display panel consists of front and rear substrates 122 and 124 formed of a transparent glass based material. The front substrate 122 confronting the rear substrate 124 in parallel to leave a gap of 100~200 μm between them. In doing so, a plurality of barrier ribs 126 are provided to the rear substrate 124 by thick film printing to maintain the gap from the front substrate 122. A plurality of the barrier ribs 126 leave a distance of 400 μm from each other and a width of each of the barrier ribs 126 amounts to 50 μm.

And, a column electrode Xj (j=1, 2, , m) of an X-electrode made of Al or Al alloy is provided 100 nm thick in parallel between the barrier ribs 126 to perform an addressing function. And, an R/G/B fluorescent layer having a thickness of 10~30 μm covers each of the X-electrodes to form a luminous layer 136.

Meanwhile, row electrodes Yi and Zi (I=1, 2, , n) of Y- and Z-electrodes are formed on a surface of the front substrate 122 confronting the rear substrate 124 to be vertical to the X-electrode. The Y- and Z-electrodes are formed about several hundreds mm by deposition of ITO, SnO, or the like to extend parallel to each other. And, the row electrodes Yi and Zi adjacent to each other form a pair to configure a row electrode pair (Yi, Zi).

Metal based bus electrodes αi and βi are formed narrower than the row electrodes Yi and Zi to adhere closely to the row electrodes Yi and Zi, respectively. The bus electrodes αi and βi are supplementary electrodes for compensating conductivity of the row electrodes Yi and Zi.

A dielectric layer 130 is formed about 20~30 μm thick to protect the row electrodes Yi and Zi. An MgO layer 132 formed of magnesium oxide (MgO) is stacked about several hundreds nm thick on the dielectric layer 13.

After completion of forming the respective electrodes Xj, Yi, Zi, αi and βi, dielectric layer 130, and luminous layer 136, the front and rear substrates 122 and 124 are bonded to each other. After a discharge space 128 has been exhausted, a surface of the MgO layer 132 is dehydrated by baking. Subsequently, mixed inert gas including 3~7% NeXe gas thereof is injected into the discharge space 128 at 400~600 torr.

A unit luminous area is defined as a pixel cell P(i, j) centering around an intersection point between the electrodes Yi and Zi and the electrode Xj. In the pixel cell P(i, j), when a wall voltage is generated from addressing discharge between the electrodes Xj and Yi, sustain pulse are applied between the electrodes Yi and Zi to maintain discharge so that the fluorescent body of the luminous layer 136 can be excited to emit light. And, the light emission can be controlled by the voltage application between the electrodes Xj, Yi, and Zi via selection, maintain, and elimination of the luminous discharge of the pixel cell P(i, j).

In doing so, the sustain pulses are alternately applied to the electrode Yi and the electrode Zi, respectively. Namely, if the sustain pulse is applied to the electrode Yi, it is not applied to the electrode Zi. And, if the sustain pulse is applied to the electrode Zi, it is not applied to the electrode Yi. Thus, the surface discharge using AC can be maintained.

FIG. 2 is a circuit diagram of a general sustain pulse drive unit for supplying sustain pulses to Y-electrode and Z-electrode. And, FIG. 3 is a waveform graph of sustain pulses generated from the sustain pulse drive unit according to the related art shown in FIG. 2.

Referring to FIG. 2, a general sustain pulse drive unit includes an energy recovery circuit for being efficiently supplied with energy necessary for generating a high-voltage sustain pulse.

The general sustain pulse drive unit consists of a Y-electrode sustain pulse drive circuit and a Y-electrode sustain pulse drive circuit. And, a circuit configuration of a Y-electrode sustain pulse drive circuit 210 is identical to that of a Z-electrode sustain pulse drive circuit 220.

The general sustain pulse drive unit operates according to a 4-steps operational sequence.

First of all, in a first operational step, a first switch S1 included in the Y-electrode sustain pulse drive unit 210 is turned on, while second to fourth switches S2 to S4 are turned off. Hence, energy stored in a capacitor CS is supplied to another capacitor CP so that a sustain pulse voltage (hereinafter abbreviated VPY) applied to a Y-electrode can rise. In this case, the latter capacitor CP indicates capacitance by discharge cells of a plasma display panel.

In a second operational step, the first and second switches S1 and S2 are turned on, while the third and fourth switches S3 and S4 are turned off. Hence, the VPY maintains a sustain voltage VS.

In a third operational step, the third switch S3 is turned on, while the first, second, and fourth switches S1, S2, and S4 are turned off. Hence, the energy stored in the latter capacitor CP is discharged to the former capacitor CS to be recovered and the VPY drops.

Finally, in a fourth operational step, the third and fourth switches S3 and S4 are turned on, while the first and second switches S1 and S2 are turned of. Hence, the VPY becomes a ground level.

In accordance with the operation of the Y-electrode sustain pulse drive unit 210, the sustain pulse voltage is provided to be applied to the Y-electrode.

In order for the plasma display panel to maintain discharge, AC voltage should be applied to the Y-electrode and the Z-electrode. Hence, an operation of the Z-electrode sustain pulse drive unit 220 starts at a beginning timing point of the fourth operational step of the Y-electrode sustain pulse drive unit 210.

An operation of the Z-electrode sustain pulse drive unit 220 is as good as that of the Y-electrode sustain pulse drive unit 210. Hence, a waveform of the sustain pulse applied to the Y- or Z-electrode follows that shown in FIG. 3.

FIG. 4 is a layout of a circuit board of a drive device for a plasma display panel according to a related art. Referring to FIG. 4, a central arithmetic logical unit 410 for controlling video signal processing is located at a central part of a plasma display panel 400. A substrate 420 having a Y-electrode sustain pulse drive unit 210 formed thereon and a substrate 430 having a Z-electrode sustain pulse drive unit 220 formed thereon are provided to left and right sides of the central arithmetic logical unit 410, respectively.

And, a scan drive substrate 440 is arranged next to the substrate 420 having the Y-electrode sustain pulse drive unit 210 formed thereon. Moreover, a data drive substrate 400 for applying a data pulse to an X-electrode is arranged on the plasma display panel 400.

FIG. 5 is a waveform graph of a drive waveform outputted from a drive device of a plasma display panel according to a related art. Referring to FIG. 5, by the substrate 420 having the Y-electrode sustain drive unit 210 formed thereon, the substrate 430 having the Z-electrode sustain drive unit 220 formed thereon, and the scan drive substrate 440, a drive waveform applied to the Y- or Z-electrode is divided into a reset section for new addressing, an addressing section, and a sustain section.

And, the sustain section of the waveform in FIG. 5 is provided by the operations of the Y-electrode sustain drive unit 210 and the Z-electrode sustain drive unit 220 which were explained with reference to FIG. 2 and FIG. 3.

However, in the arrangement of the circuit board having the drive device of the plasma display panel in FIG. 4, since the sustain pulse applied to the Y-electrode is supplied to the plasma display panel via a scan IC included in the scan drive substrate 440, energy loss takes place to lower drive efficiency.

Moreover, since the substrate 420 having the Y-electrode sustain pulse drive unit 210 formed thereon and the substrate 430 having the Z-electrode sustain pulse drive unit 220 formed thereon are provided to the left and right sides of the central arithmetic logical unit 410, respectively, an overall volume of the device increases.

SUMMARY OF THE INVENTION

Accordingly, an object of the present invention is to solve at least the problems and disadvantages of the background art.

An object of the present invention is to provide an apparatus for driving a plasma display panel and method thereof, by which drive efficiency is raised and by which an overall volume of the apparatus can be reduced.

According to an embodiment of the present invention, an apparatus of driving an AC surface discharge type plasma display panel, which includes X-, Y-, and Z-electrodes for discharge initiation and discharge sustain, includes a central arithmetic logical unit, a reset drive unit, a data drive unit, a scan drive unit, and a sustain drive unit wherein the sustain drive unit includes a unified sustain drive unit.

According to an embodiment of the present invention, an apparatus of driving an AC surface discharge type plasma display panel, which includes X-, Y-, and Z-electrodes for discharge initiation and discharge sustain, includes a central arithmetic logical unit controlling processing of a video signal displayed via the plasma display panel, a unified sustain drive unit applying a pulse for performing a sustain function, a reset drive unit and a scan drive unit applying a pulse for performing a reset function and an addressing function among drive waveforms of the plasma display panel, and a data drive unit applying a data pulse to the X-electrode during an addressing process.

According to an embodiment of the present invention, a method of driving an AC surface discharge type plasma display panel, which includes X-, Y-, and Z-electrodes for discharge initiation and discharge sustain, includes a discharge initiation step and a discharge sustain step wherein in the discharge sustain step, a ground potential is applied to the Y-electrode and sustain pulses having alternate polarities are applied to the Z-electrode.

According to an embodiment of the present invention, a method of driving an AC surface discharge type plasma display panel, which includes X-, Y-, and Z-electrodes for discharge initiation and discharge sustain, includes a discharge initiation step and a discharge sustain step wherein in the discharge sustain step, a constant DC potential is applied to the Y-electrode and sustain pulses having alternate polarities are applied to the Z-electrode.

Therefore, in the apparatus for driving a plasma display panel and method thereof according to the embodiments of the present invention, the sustain drive unit is included, whereby the drive efficiency is raised, the drive circuit is simplified, and the overall volume is reduced.

BRIEF DESCRIPTION OF THE DRAWINGS

The invention will be described in detail with reference to the following drawings in which like numerals refer to like elements.

FIG. 8 is a diagram showing an example of a unified sustain drive unit in accordance with one embodiment of the present invention.

DETAILED DESCRIPTION OF PREFERRED EMBODIMENTS

Figure 1:
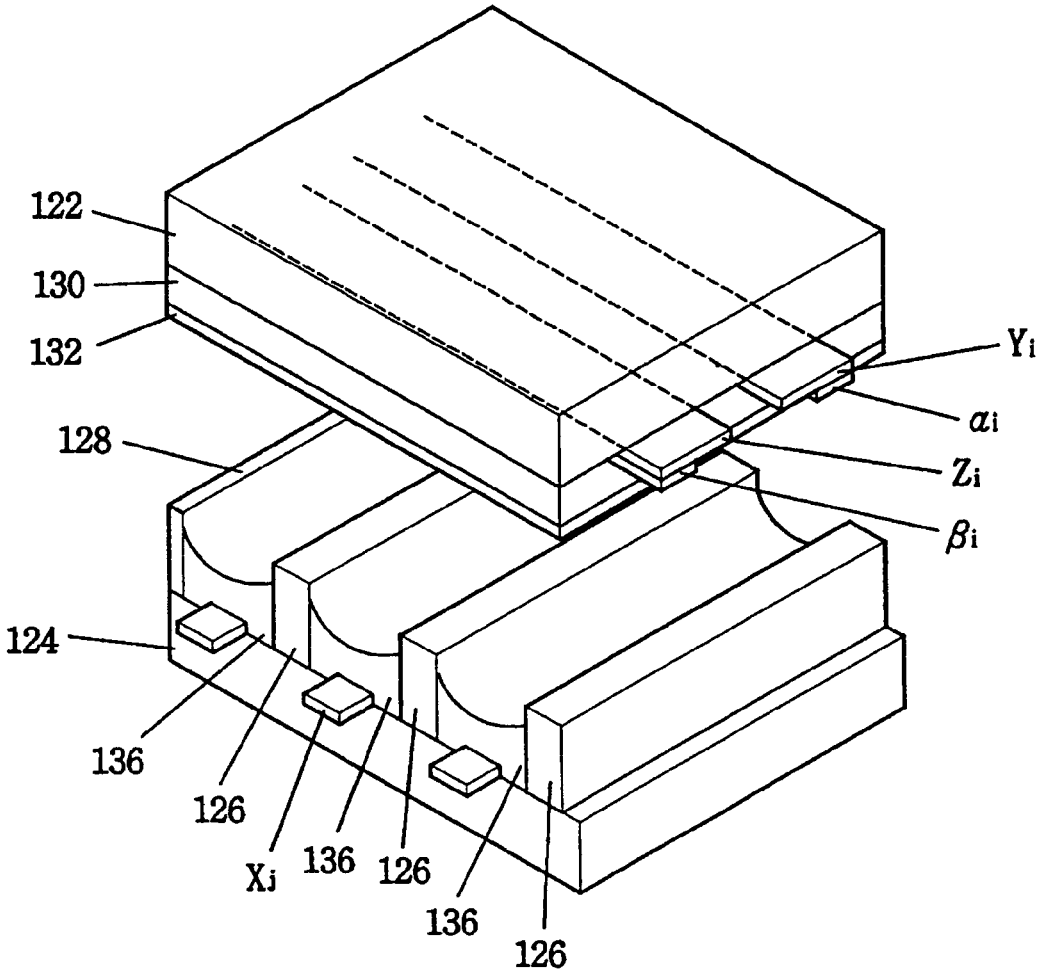
FIG. 1 is a perspective diagram of a general AC type surface discharge plasma display panel.
Figure 2:
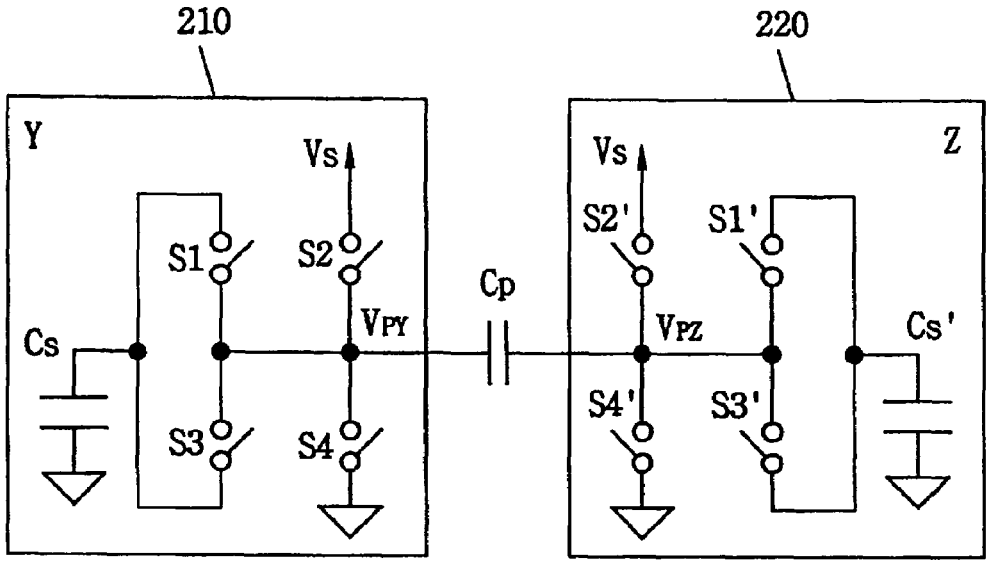
FIG. 2 is a circuit diagram of a general sustain pulse drive unit for supplying sustain pulses to Y-electrode and Z-electrode.
Figure 3:
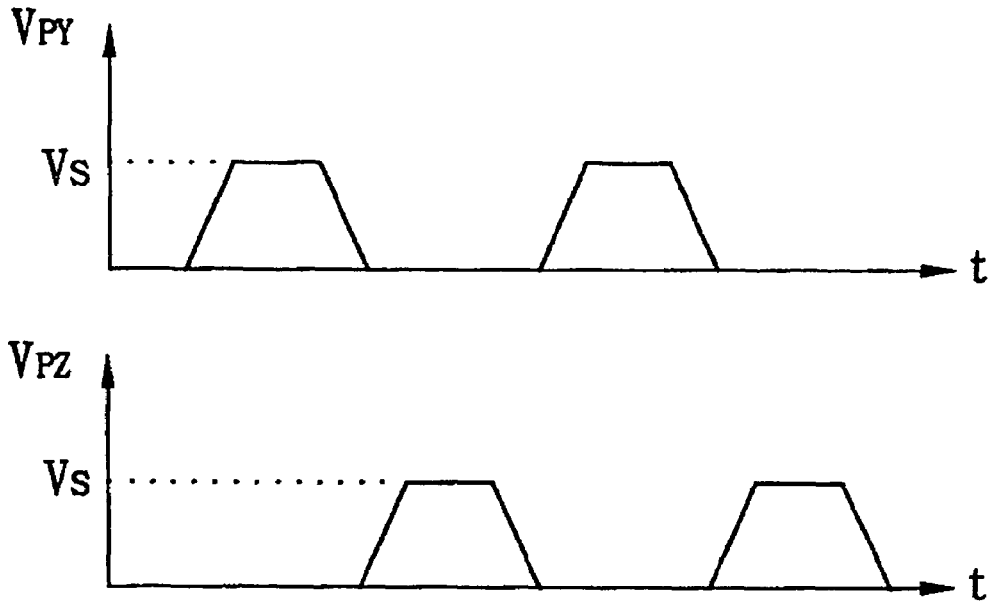
FIG. 3 is a waveform graph of sustain pulses generated from the sustain pulse drive unit according to the related art shown in FIG. 2.
Figure 4:
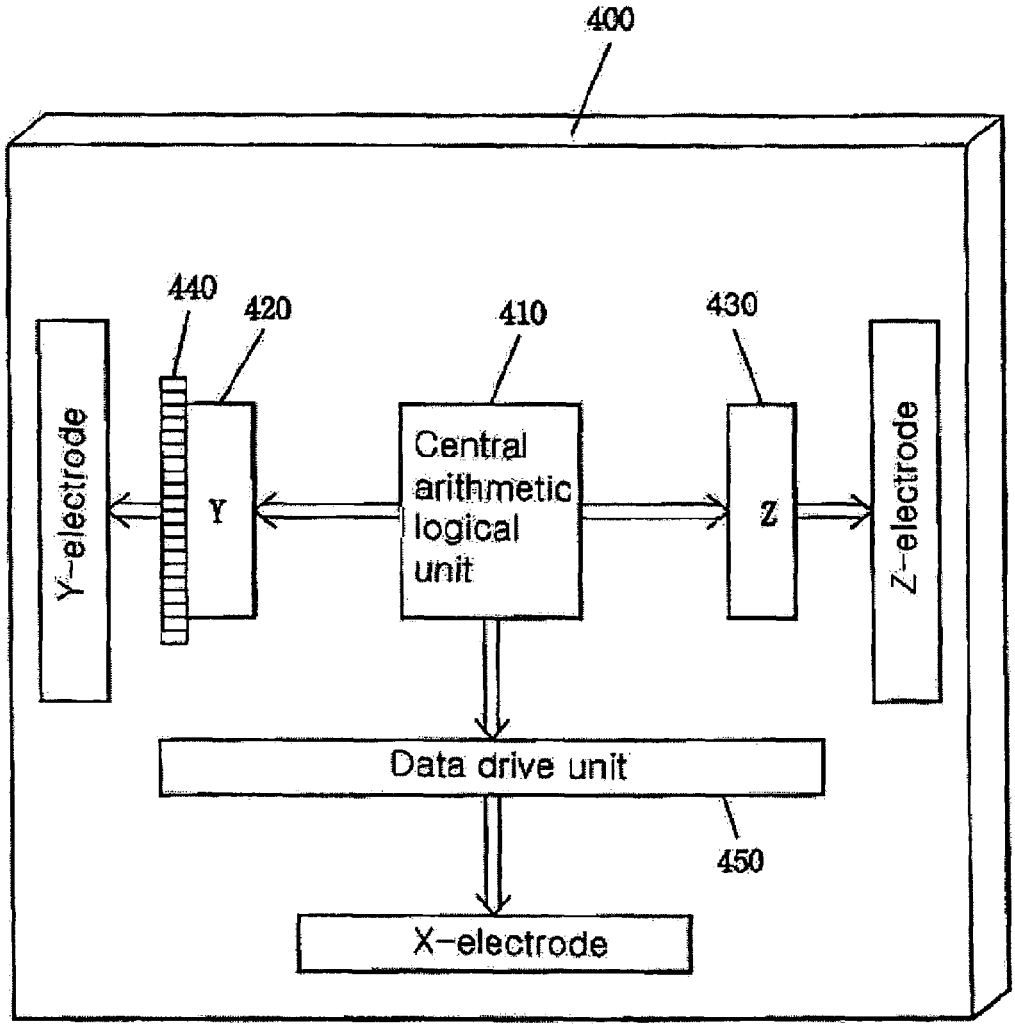
FIG. 4 is a layout of a circuit board of a drive device for a plasma display panel according to a related art.

Preferred embodiments of the present invention will be described in a more detailed manner with reference to the drawings.

According to an embodiment of the present invention, an apparatus of driving an AC surface discharge type plasma display panel, which includes X-, Y-, and Z-electrodes for discharge initiation and discharge sustain, includes a central arithmetic logical unit, a reset drive unit, a data drive unit, a scan drive unit, and a sustain drive unit wherein the sustain drive unit includes a unified sustain drive unit.

The unified sustain drive unit applies sustain pulses having alternate polarities to the Z-electrode.

The Y-electrode stays at a ground level while the unified sustain drive unit applies the sustain pulses having the alternate polarities to the Z-electrode.

The Y-electrode stays at a constant DC level while the unified sustain drive unit applies the sustain pulses having the alternate polarities to the Z-electrode.

And, either the reset drive unit or the scan drive unit applies a signal at a ground level to the Y-electrode while the unified sustain drive unit applies the sustain pulses having the alternate polarities to the Z-electrode.

And, either the reset drive unit or the scan drive unit applies a signal at a constant DC level to the Y-electrode while the unified sustain drive unit applies the sustain pulses having the alternate polarities to the Z-electrode.

According to an embodiment of the present invention, an apparatus of driving an AC surface discharge type plasma display panel, which includes X-, Y-, and Z-electrodes for discharge initiation and discharge sustain, includes a central arithmetic logical unit controlling processing of a video signal displayed via the plasma display panel, a unified sustain drive unit applying a pulse for performing a sustain function, a reset drive unit and a scan drive unit applying a pulse for performing a reset function and an addressing function among drive waveforms of the plasma display panel, and a data drive unit applying a data pulse to the X-electrode during an addressing process.

The unified sustain drive unit applies sustain pulses having alternate polarities to the Z-electrode.

The Y-electrode stays at a ground level while the unified sustain drive unit applies the sustain pulses having the alternate polarities to the Z-electrode.

The Y-electrode stays at a constant DC level while the unified sustain drive unit applies the sustain pulses having the alternate polarities to the Z-electrode.

And, either the reset drive unit or the scan drive unit applies a signal at a ground level to the Y-electrode while the unified sustain drive unit applies the sustain pulses having the alternate polarities to the Z-electrode.

And, either the reset drive unit or the scan drive unit applies a signal at a constant DC level to the Y-electrode while the unified sustain drive unit applies the sustain pulses having the alternate polarities to the Z-electrode.

According to an embodiment of the present invention, a method of driving an AC surface discharge type plasma display panel, which includes X-, Y-, and Z-electrodes for discharge initiation and discharge sustain, includes a discharge initiation step and a discharge sustain step wherein in the discharge sustain step, a ground potential is applied to the Y-electrode and sustain pulses having alternate polarities are applied to the Z-electrode.

In the discharge sustain step, the applying the sustain pulses having the alternate polarities to the Z-electrode is performed by a unified sustain drive unit.

In the discharge sustain step, the applying the ground potential to the Y-electrode is performed by either a reset drive unit or a scan drive unit.

According to an embodiment of the present invention, a method of driving an AC surface discharge type plasma display panel, which includes X-, Y-, and Z-electrodes for discharge initiation and discharge sustain, includes a discharge initiation step and a discharge sustain step wherein in the discharge sustain step, a constant DC potential is applied to the Y-electrode and sustain pulses having alternate polarities are applied to the Z-electrode.

In the discharge sustain step, the applying the sustain pulses having the alternate polarities to the Z-electrode is performed by a unified sustain drive unit.

In the discharge sustain step, the applying the constant DC potential to the Y-electrode is performed by either a reset drive unit or a scan drive unit.

Hereinafter, the embodiments of the present invention will be described with reference to the drawings.

Figure 6:
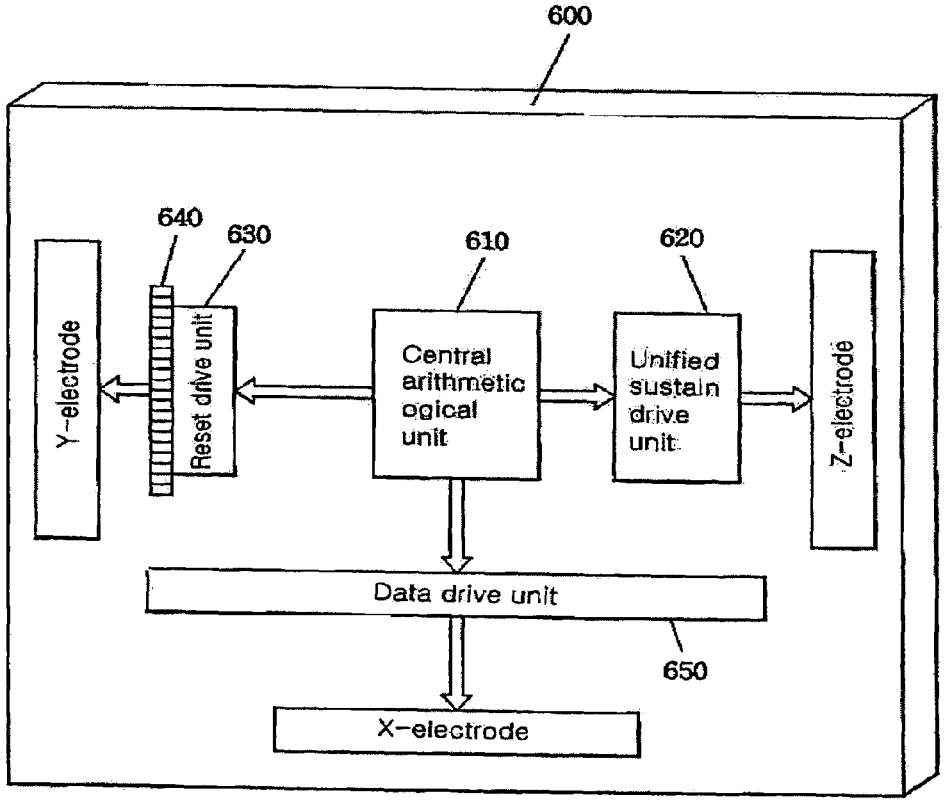
FIG. 6 is a layout of an apparatus for driving a plasma display panel according to the present invention.

First of all, FIG. 6 is a layout of an apparatus for driving a plasma display panel according to the present invention. Referring to FIG. 6, an apparatus for driving a plasma display panel according to the present invention includes a central arithmetic logical unit 610, a unified sustain drive unit 620, a reset drive unit 640, and a data drive unit 650.

The central arithmetic logical unit 610 controls the processing of a video signal displayed on a plasma display panel.

The unified sustain drive unit 620 outputs sustain pulses, of which magnitude are equal to each other and of which polarities alternate, to a Z-electrode. Thus, as the unified sustain drive unit 620 applies the sustain pulses, of which magnitude are equal to each other and of which polarities alternate, to the Z-electrode, it is able to provide a Y-electrode sustain drive unit 210 and a Z-electrode sustain drive unit 220, which were separated from each other in the related art, to one substrate. Moreover, the sustain pulse impression can be performed via the unified sustain drive unit 620 provided on one substrate.

The reset drive unit 630 and the scan drive unit 640 apply pulses for carrying out a reset function and an addressing function of the plasma display panel to a Y-electrode, respectively.

Accordingly, the reset drive unit 630 and the scan drive unit 640 output signals of 0V or constant DC level each to bring about AC surface discharge while the sustain drive unit 620 applies the sustain pulses having alternate polarities to the Z-electrode.

And, the data drive unit 650 applies a data pulse to an X-electrode during an addressing process.

Figure 7:
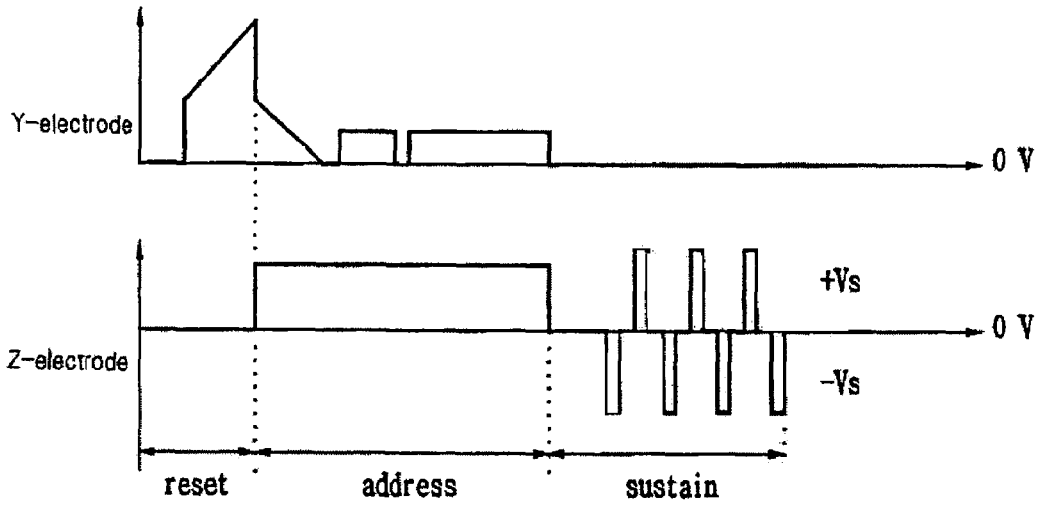
FIG. 7 is a waveform graph of a drive waveform outputted from an apparatus for driving a plasma display panel according to the present invention.

FIG. 7 is a waveform graph of a drive waveform generated from an apparatus for driving a plasma display panel according to the present invention.

Referring to FIG. 7, a drive waveform applied to a plasma display panel includes specific waveforms differing from each other during reset, addressing, and sustain sections, respectively.

Figure 5:
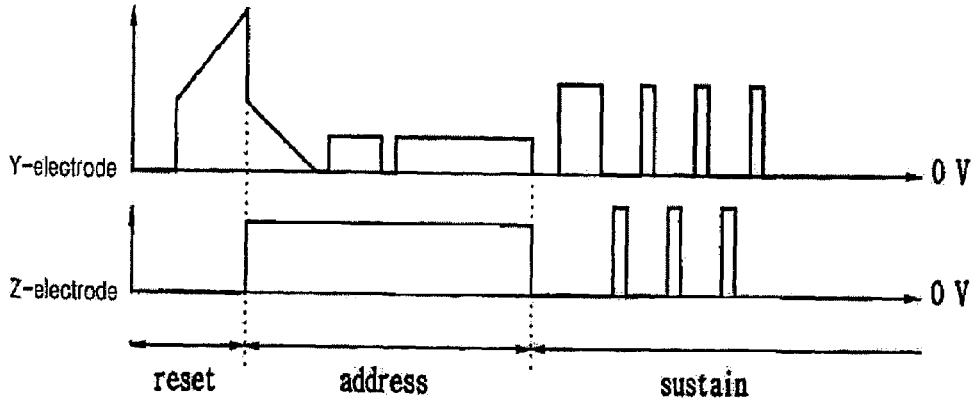
FIG. 5 is a waveform graph of a drive waveform outputted from a drive device of a plasma display panel according to a related art.

Comparing FIG. 7 to FIG. 5, the drive waveform of the present invention is different from that of the related art during the sustain section in that sustain pulses having the alternate polarities are applied to a Z-electrode and that a Y-electrode maintains a ground level or a constant DC level. Thus, the discharge of the AC surface discharge type plasma display panel can be sustained.

In the drive waveform shown in FIG. 7, waveforms of the reset and addressing sections are applied to the Y-electrode by the reset drive unit 630 and the addressing drive unit 640 of the drive apparatus shown in FIG. 6. And, a waveform of the sustain section is applied to the Z-electrode by the unified sustain drive unit 620 of the drive apparatus shown in FIG. 6. The unified sustain drive unit 620 generates the alternating sustain pulses so that the plasma display panel can maintain the discharge during the sustain section. The sustain waveform, as shown in FIG. 7, includes a plurality of alternate positive and negative rectangular waves, thereby enabling not to be applied to the Y-electrode but to be applied to the Z-electrode.

Accordingly, the present invention enables to raise the drive efficiency in a manner of applying the sustain pulses to the Z-electrode by the unified sustain drive unit 620 instead of applying the sustain pulses to the Y-electrode via the substrate provided with the scan drive unit 640. And, the present invention unifies a pair of the related art sustain drive units 210 and 220 into one, thereby enabling to simplify the circuit configuration and to reduce the circuit volume.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for driving an AC surface discharge type plasma display panel which includes first, second, and third electrodes for discharge initiation and discharge sustain, wherein the apparatus includes a central arithmetic logical unit, a reset drive unit, a data drive unit, a scan drive unit, and a sustain drive unit, and wherein the sustain drive unit includes a unified sustain drive unit that applies sustain pulses having alternately opposite polarity to the third electrode while either the reset drive unit or the scan drive unit applies a substantially constant level signal to the second electrode during a sustain period, and wherein the second electrode is one of a scan electrode or a sustain electrode and the third electrode is the other of the scan electrode or the sustain electrode.

2. The method of claim 1, wherein the sustain pulses alternate between a first positive voltage and a second negative voltage.

3. The method of claim 2, wherein the first positive voltage and the second negative voltage has a same absolute value.

4. The apparatus of claim 1, wherein the first, second, and third electrodes are X, Y, and Z electrodes respectively.

5. The apparatus of claim 4, wherein the Y-electrode stays at a ground level while the unified sustain drive unit applies the sustain pulses having alternately opposite polarity to the Z-electrode.

6. The apparatus of claim 4, wherein the Y-electrode stays at a constant DC level while the unified sustain drive unit applies the sustain pulses having alternately opposite polarity to the Z-electrode.

7. The apparatus of claim 4, wherein either the reset drive unit or the scan drive unit applies a signal at a ground level to the Y-electrode while the unified sustain drive unit applies the sustain pulses having alternately opposite polarity to the Z-electrode.

8. The apparatus of claim 4, wherein either the reset drive unit or the scan drive unit applies a signal at a constant DC level to the Y-electrode while the unified sustain drive unit applies the sustain pulses having alternately opposite polarity to the Z-electrode.

9. An apparatus of driving an AC surface discharge type plasma display panel which includes first, second, and third electrodes for discharge initiation and discharge sustain, the apparatus comprising:

a central arithmetic logical unit controlling processing of a video signal displayed via the plasma display panel;

a unified sustain drive unit applying sustain pulses having alternately opposite polarity to the third electrode;

a reset drive unit and a scan drive unit applying a pulse for performing a reset function and an addressing function among drive waveforms of the plasma display panel;

a data drive unit applying a data pulse to the first electrode during an addressing process; and a unified sustain drive unit applying pulses having alternately opposite polarity to a third electrode while either the reset drive unit or the scan drive unit applies a substantially constant level signal to the second electrode during a sustain period, wherein the second electrode is one of a scan electrode or a sustain electrode and the third electrode is the other of the scan electrode or the sustain electrode.

10. The apparatus of claim 9, wherein the wherein the first, second, and third electrodes are X, Y, and Z electrodes respectively.

11. The apparatus of claim 10, wherein the Y-electrode stays at a ground level while the unified sustain drive unit applies the sustain pulses having alternately opposite polarity to the Z-electrode.

12. The apparatus of claim 10, wherein the Y-electrode stays at a constant DC level while the unified sustain drive unit applies the sustain pulses having alternately opposite polarity to the Z-electrode.

13. The apparatus of claim 10, wherein either the reset drive unit or the scan drive unit applies a signal at a ground level to the Y-electrode while the unified sustain drive unit applies the sustain pulses having alternately opposite polarity to the Z-electrode.

14. The apparatus of claim 10, wherein either the reset drive unit or the scan drive unit applies a signal at a constant DC level to the Y-electrode while the unified sustain drive unit applies the sustain pulses having alternately opposite polarity to the Z-electrode.

15. A method of driving an AC surface discharge type plasma display panel which includes first, second, and third electrodes for discharge initiation and discharge sustain, wherein the method includes a discharge initiation step and a discharge sustain step, and wherein in the discharge sustain step, a ground potential is applied to the second electrode and sustain pulses having alternately opposite polarity are applied to the third electrode while either a reset drive unit or a scan drive unit applies a substantially constant level signal to the second electrode during a sustain period, wherein the second electrode is one of a scan electrode or a sustain electrode and the third electrode is the other of the scan electrode or the sustain electrode.

16. The method of claim 15, wherein the first, second, and third electrodes are X, Y, and Z electrodes respectively.

17. The method of claim 16, wherein, in the discharge sustain step, the applying the sustain pulses having alternately opposite polarity to the Z-electrode is performed by a unified sustain drive unit.

18. The method of claim 16, wherein, in the discharge sustain step, the applying the ground potential to the Y-electrode is performed by either a reset drive unit or a scan drive unit.

19. A method of driving an AC surface discharge type plasma display panel which includes first, second, and third electrodes for discharge initiation and discharge sustain, wherein the method includes a discharge initiation step and a discharge sustain step and wherein in the discharge sustain step, a constant DC potential is applied to the second electrode and sustain pulses having alternately opposite polarity are applied to the third electrode while either a reset drive unit or a scan drive unit applies a substantially constant level signal to the second electrode during a sustain period, wherein the second electrode is one of a scan electrode or a sustain electrode and the third electrode is the other of the scan electrode or the sustain electrode.

20. The method of claim 19, wherein the first, second, and third electrodes are X, Y, and Z electrodes respectively.

21. The method of claim 20, wherein, in the discharge sustain step, the applying the sustain pulses having the alternate polarities to the Z-electrode is performed by a unified sustain drive unit.

22. The method of claim 20, wherein, in the discharge sustain step, the applying the constant DC potential to the Y-electrode is performed by either a reset drive unit or a scan drive unit.

* * * * *